United States Patent [19]

Trout

[11] 4,271,631

[45] Jun. 9, 1981

[54] SELF-LOCKING AUTOMATICALLY-RELEASING SASH BALANCE FOR TILTABLY-REMOVABLE SLIDING SASH WINDOWS

[76] Inventor: Donald M. Trout, 15514 Forrer Rd., Detroit, Mich. 48227

[21] Appl. No.: 24,872

[22] Filed: Mar. 28, 1979

[51] Int. Cl.[3] ..... E05D 15/22; E05D 13/12

[52] U.S. Cl. ..... 49/181; 49/446; 49/453

[58] Field of Search ..... 49/181, 176, 446, 453

[56] References Cited

U.S. PATENT DOCUMENTS

| | | | |
|---|---|---|---|
| 3,524,282 | 8/1970 | Kraft et al. | 49/181 |
| 3,611,636 | 10/1971 | Trout | 49/181 |
| 3,676,956 | 7/1972 | Taylor et al. | 49/181 X |
| 3,797,168 | 3/1974 | Trout | 49/181 |

*Primary Examiner*—Philip C. Kannan
*Attorney, Agent, or Firm*—Barnes, Kisselle, Raisch & Choate

[57] ABSTRACT

Each sash of this double-hung tiltably-removable sliding sash window installation slides in an elongated channel sash guide containing a sash balancing spring anchored at its upper end thereto and connected at its lower end to a lock carrier upon which is rotatably mounted a pointed locking lever. This lever cooperates with an eccentric lock-operating pin mounted on the pivot boss of a block mounted in the lower portion of the groove in the opposite side edges of each sash in such a manner that when the sash is moved around its pivot bosses into the plane of the window frame, the eccentric pin on each side is automatically moved laterally relatively to its respective locking lever so as to push the locking lever out of its locking position, thereby releasing each of the opposite sash-balancing springs into its sash-balancing position. When, however, the sash is tilted outward for cleaning or removal, each eccentric pin is moved automatically sidewise in the opposite direction to push its associated locking lever into its locking position, whereupon the sash may be removed by swinging it sidewise in its tilted position while leaving the sash balance locking springs in their tensioned positions. The locking lever is mounted in its channel sash guide in a plane perpendicular to the plane of the sash.

9 Claims, 17 Drawing Figures

FIG.3
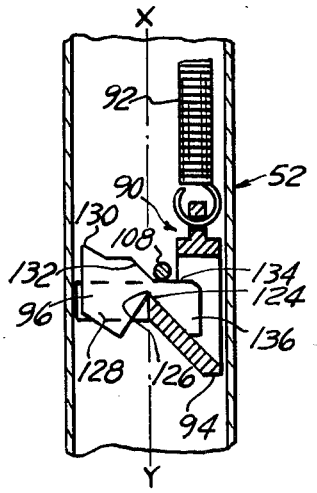
FIG.4
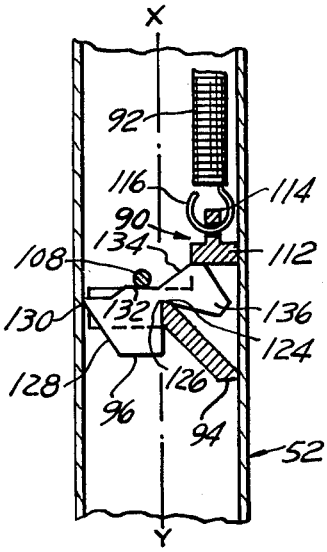
FIG.5
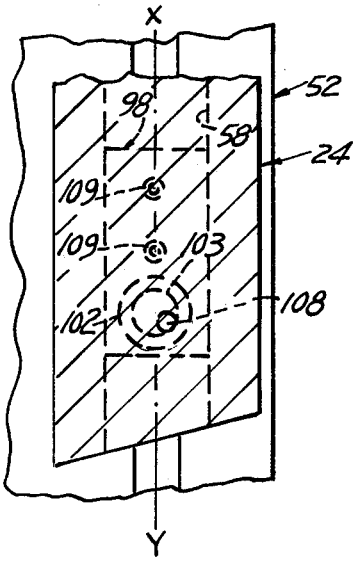
FIG.6
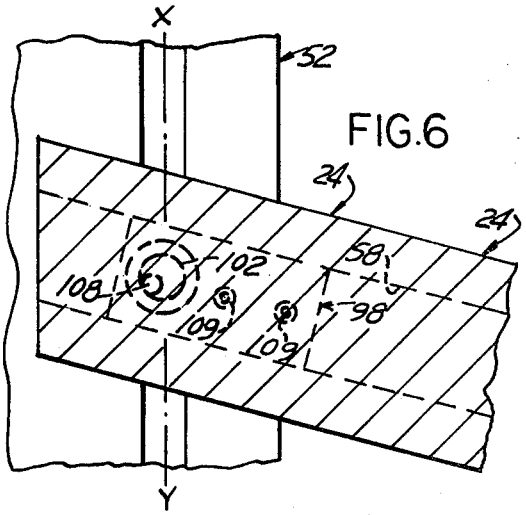
FIG.7
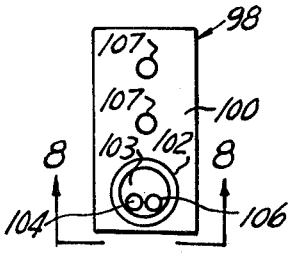
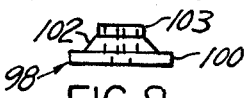
FIG.8
FIG.9
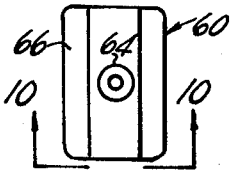
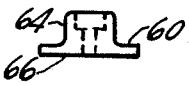
FIG.10
FIG.11
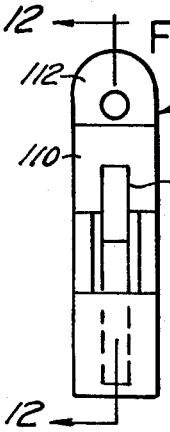
FIG.12
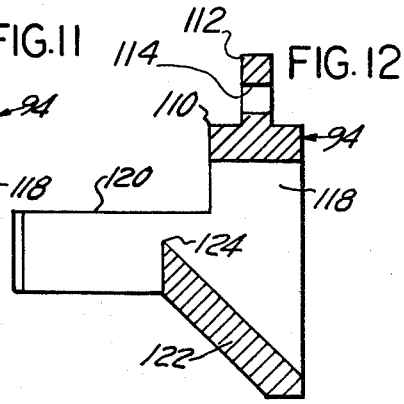

SELF-LOCKING AUTOMATICALLY-RELEASING SASH BALANCE FOR TILTABLY-REMOVABLE SLIDING SASH WINDOWS

BACKGROUND OF THE INVENTION

My prior U.S. Pat. No. 3,197,819 of Aug. 3, 1965 disclosed and claimed a self-locking automatically-releasing sash balance for double-hung non-tiltable sliding sash windows. In contrast, the present invention provides a self-locking automatically-releasing sash balance for tiltably removable sliding sash windows. It also provides yieldable sash keepers for yieldingly holding the sashes in the window frame so as to prevent the sashes from being pulled open by wind action without dependence upon the thrust of the sash sides against the respective slide guide channel members which vary in dimensions, as in the prior art.

SUMMARY OF THE INVENTION

The present invention resides in the lower portions of the upper and lower sashes having lock carriers rockably supporting the pointed locking levers in a transverse position perpendicular to the sash planes and automatically tilted by eccentric pivot pins secured to and movable bodily sidewise with the sash in response to the tilting of the sash inward into the window frame so as to unlock the locking levers and release the sash balancing springs into their sash balancing positions yet instantly locking the locking levers in response to tilting the sash outward from the window frame so as to lock the balancing springs in their tensioned conditions while the sash is being tilted for cleaning or removal. The present invention also resides in the yieldable retention of the sashes in the window frame by sash keepers secured to the upper portions of the upper and lower sashes and having yielding engagement with the beaded flat front faces of the sash guide channels. In the drawings, FIG. 1 is a diagrammatic front elevation of a double-hung tiltable sliding sash window installation viewed from the outside of the building and showing the location of the mechanisms constituting the invention;

FIG. 3 is a vertical section taken along the line 3—3 in FIG. 2A, showing the lower end of one of the balancing springs, lock carrier and locking lever held in its unlocked sash-balancing position by the eccentric pin of the lock-operating pivot;

FIG. 4 is a view similar to FIG. 3, but showing the eccentric pin moved sidewise in response to the tilting of the sash around its lock-operating pivots to urge the locking lever into its locking position;

FIG. 5 is a vertical section taken along the line 5—5 in FIG. 2A showing the position of the locking-operating eccentric pin of one of the lock-operating pivots mounted in the sash side groove in contrast to the unlocked position shown in FIG. 3;

FIG. 6 is a view similar to FIG. 5 but with the sash tilted and the eccentric lock-operating pin consequently moved into its lever-locking position shown in FIG. 4;

FIG. 7 is a front elevation of one of the pivot bosses on its mounting block as shown in FIGS. 5 and 6 but with the eccentric lock-operating pin omitted and having separate holes for receiving such a pin for either right-hand or left-hand positions in the window sash edge;

FIG. 8 is a bottom plan view looking in the direction 8—8 in FIG. 7;

FIG. 9 is a front elevation of one of the opposite sash keepers adapted to be fastened to opposite sides of the upper portion of the sash side groove and having a pivot nub coaxial with the pivot boss for engagement with the beaded opposite edges of the front wall slot in the sash guide channel;

FIG. 10 is a bottom plan view of one of the opposite sash keepers viewed in FIG. 9, taken along the line 10—10 therein;

FIG. 11 is a front elevation, upon an enlarged scale, of the lock carrier shown in FIGS. 3 and 4;

FIG. 12 is a vertical section taken along the line 12—12 in FIG. 11;

Figures 1, 2A, 2B, 13, 14, 15, 16:
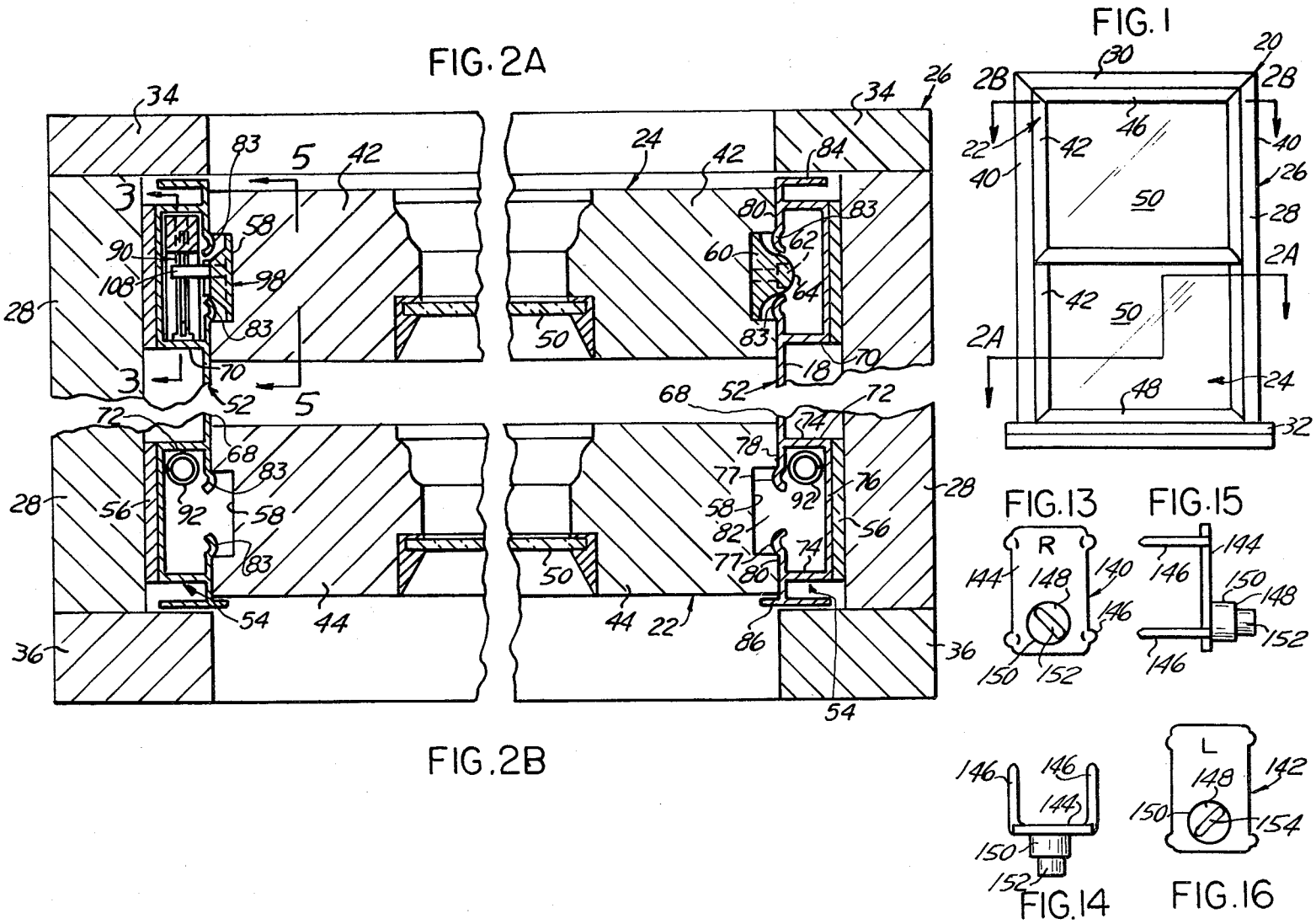
FIGS. 2A and 2B are enlarged horizontal sections through the lower and upper portions respectively of the window taken along the lines 2A—2A and 2B—2B in FIG. 1, with the central sash portions and window sill omitted to conserve space and enable the showing to be made on a larger scale than otherwise.
FIG. 13 is a front elevation of a modification of the lock-operating pivot shown in FIGS. 7 and 8, similarly adapted for installation in the lower portion of the right-hand side groove of the sash.
FIG. 14 is a top plan view of the lock-operating pivot shown in FIG. 13.
FIG. 15 is a left-hand side elevation of the modification shown in FIG. 13.
FIG. 16 is a front elevation of the modified lock-operating pivot shown in FIG. 13, but adapted for installation in the lower portion of the left-hand side groove of the sash.

Referring to the drawings in detail, FIG. 1 shows a double-hung tiltably-removable sliding sash installation, generally designated 20, as viewed from the outside of the building and including upper and lower tiltably removable sliding sashes 22 and 24 respectively mounted in a window frame 26. The window frame 26 is conventional and includes the usual side members 28 interconnected by top and bottom members 30 and 32 respectively, the latter being the usual window sill. The side members 28 are mounted between vertical inner and outer frame members 34 and 36 respectively (FIG. 2), the outer side member 36 being in turn engaged by vertical members 40 which border the window frame 26. Each of the sashes 22 and 24 is provided with the usual vertical side members 42 and 44 interconnected by horizontal sash members 46 and 48 which between them support the usual window pane 50 of glass or other suitable transparent or translucent material.

Mounted between the vertical frame members 34 and 36 on opposite sides of the window frame 26 are opposite double-hung sash guide channel members 52 and 54 (FIG. 2), these sash guide channel members being of similar but oppositely-facing construction more fully described below and conveniently extruded from suitable resilient synthetic plastic material. These are separated from their respective window frame side members 28 by spacing strips 56 which also provide insulation. Each of the sash side members 42 and 44 is provided on its outer side with a sash groove or recess 58. The upper portion of the sash groove 58 on each of the opposite sides of each sash 22 and 24 (FIG. 2) contains a sash keeper 60 shown in more detail in FIGS. 9 and 10 and drilled and countersunk to be secured by a fastener 62 to its respective side member 42 or 44. The sash keeper 60 yieldingly and frictionally engages the guide channel 54 by means of a rounded ridge 64 projecting from and integral with a base 66 of elongated rectangular shape.

In certain prior art sliding sash windows, the opposite vertical side members of the sash are provided with longitudinal grooves of frusto-conical cross-section which are frictionally engaged by the correspondingly-angled front wall portions of the channel sash guide on opposite sides of the longitudinal slit therein. This prior construction has been relied upon to frictionally counterbalance the weight of the sash, as well as to yield in withdrawing the sash from the window frame for cleaning or removal. In practice, however, it has been found that such sash guide channels cannot be held to sufficiently close tolerances during manufacture to give a sufficiently precise frictional counterbalancing force on the sash, with the result that the sash slides up and down either too loosely or too stiffly, with a correspondingly variable force required to insert or remove the sash with respect to the window frame.

The present invention by the utilization of the sash keepers 60 of FIGS. 9 and 10 eliminates this uncertainty of construction and operation. Since the front wall portions 78 and 80 (FIG. 2B) are flat, lie in substantially the same plane, and are substantially parallel to the rear wall 76, precise manufacturing tolerances are easy to maintain and results are uniform in operation. Furthermore, the beaded edges 83 on the front wall portions 77 of the sash guide channels (FIG. 2B) deflect the corner edge portions of the sash while it is being tilted back into position during its insertion or removal with respect to the window frame.

Each guide channel member 52 or 54 consists of a central bridge portion 68 (FIGS. 2A and 2B) extending between and interconnecting an inner sash guide channel 70 and an outer sash guide channel 72. Each of the guide channels 52 and 54 is of rectangular cross-section and each has side walls 74 extending inward from a back wall 76 to a front wall 77 having two separated front wall portions 78 and 80 respectively with a slot 82 therebetween. The pivot nub 64 extends into the slot 82 against the beaded edges 83 of the front wall portions 78 and 80 as shown in the upper left hand corner of FIG. 2. The front wall portions 80 terminate in outwardly-extending side flanges 84 and 86 respectively, the outer side flange 86 forming with its adjacent portion 80 a T-shaped structure, whereas the inner side flange 84 with its respective portion 80 forms an L-shaped structure.

Each of the oppositely-facing double-hung sash guide channel members 52 and 54 contains a self-locking automatically-releasing sash balancing device, generally designated 90, shown in the upper left-hand corner of FIG. 2A and in various portions in FIGS. 3 to 6 inclusive, 11 and 12. It will be understood that the upper portion of the upper sash 22 is also provided with a pair of the sash keepers 60 similar to those of the lower sash 24 but above the plane of FIG. 2B, hence not shown therein.

Each self-locking automatically-releasing sash balancing assembly 90 includes a sash balance locking device, generally designated 88 (FIGS. 3 to 8 inclusive and 13 to 16 inclusive) and a sash balancing tension spring 92 mounted within its respective inner or outer sash channel portion 70 or 72 fixedly secured to the upper end thereof (FIG. 2B). The sash balance locking device 88 includes a lock carrier, generally designated 94, and a pointed locking lever 96 rockably mounted thereon in a plane transverse to the sash. The balancing assembly 90 finally includes a lock operator 98 (FIGS. 2A, 7 and 8) which consists of a base plate 100 from which projects a conical projection 102 terminating in a cylindrical pivot boss 103 coaxial with an opposite pivot boss 103 and containing two holes 104 and 106, only one of which contains a lock-operating pin 108. The two holes 104 and 106 are provided for right-hand and left-hand installations. For simplicity of description and illustration, the lock-operating pivot member 98 is shown in FIGS. 5 and 6 as having a single lock-operating pin 108 mounted in the right-hand hole 106 in the lock-operating device 98 of FIG. 7. The base plate 100 contains spaced holes 107 adapted to receive fasteners 109 (FIGS. 5 and 6).

The lock carrier 94 (FIGS. 3, 4, 11 and 12) consists of a carrier base 110 from the upper portion of which a tongue 112 extends upward and is provided with a hole 114 through which the hooked lower end 116 of the sash balancing spring 92 is inserted (FIGS. 3 and 4). The carrier base portion 110 is vertically elongated and contains a slot 118 (FIGS. 11 and 12) between forwardly-extending arm portions 120. Inclined upward into the slot 118 from the lower edge of the base 110 is a wall 122 which terminates at its upper end in a sharp fulcrum edge 124. Pivotally mounted on the sharp fulcrum edge 124 of the lock carrier 94 (FIGS. 3 and 4) is the notch 126 of the locking lever 96. The latter has a forward portion 128 with a sharp locking tip 130 from which a forward contact edge 132 extends backward to the rearward contact edge 134 of a rearward portion 136.

The operation of the invention is the same for the upper sash 22 and the lower sash 24, hence a description of the lower sash operation is believed to suffice. In the operation of the lower sash 24, let it be assumed that the sash is in its closed vertical position within the window frame 26, as shown in FIGS. 3 and 5. While it is in this position, the sash balance locking device 88 at this time is unlocked because, as shown in FIG. 5, the eccentric lock-operating pin 108 is located toward the right-hand side of the sash guide 52 to the right of the center line X-Y thereof and bears against the rearward contact edge 134 of the rearward portion 136 of the locking lever 96. In this position (FIG. 3) the eccentric lock operating pin 108 has been automatically moved to the right, thereby swinging the locking lever 96 clockwise around the sharp fulcrum edge of the lock carrier 124. This action holds the sharp locking tip 130 of the locking lever 96 out of contact with the sash guide 52 and thus leaves the balancing spring 92 free to fully sustain the weight of the sash 24.

If, now, the user desires to tilt the sash 24 inward relatively to the window frame 26 for cleaning or for removal, he grasps the upper edge of the sash 24 and pulls it toward him in the clockwise direction shown by the arrow in FIG. 6, thereby swinging its sash keepers 60 out of the guide channel slots 82 while deflecting their beaded edges 83. This action correspondingly swings the lock-operating pivot member 98 together with its pivot boss 103 and lock-operating pin 108 to the left past the center line X–Y so that it bears against the forward contact edge 132 (FIG. 4), rotating the pointed locking lever 96 counterclockwise around the fulcrum points 124 and 126 and causing the sharp locking tip 130 to dig into the adjacent side wall 70 of the sash guide 52. The sash balancing assembly 90 and its tension spring 93 are thus locked in the tensioned position of FIG. 4 while cleaning or removal of the sash 24 takes place.

To return the sash 24 to its vertical window-closing position, the operator reverses the foregoing procedure (FIGS. 3 and 5), thereby moving the eccentric pin 108 to the right across the center line X-Y and thereby causing it to bear against the rearward contact edge 134 of the locking lever 96. This action swings the locking lever 96 clockwise around its pivot notch 126 upon the fulcrum edge 124, thereby pulling the sharp locking tip 130 out of engagement with the adjacent side wall of the sash guide 52. The result is shown in FIG. 2A, namely that the sash balancing assembly 90 is now unlocked so that the balancing spring 92 is free to counterbalance the weight of the sash 24 to which it is attached.

The modified lock-operating pivots, generally designated 140 and 142 shown in FIGS. 13 to 15 and 16 respectively are similar in purpose to the lock-operating pivot 98 of FIGS. 9 and 10 but possess greater strength than the latter. Moreover, they can be driven into the sash grooves 58 without requiring the separate holes 107 and fasteners 109 (FIGS. 5 and 7). The lock-operating pivots 140 and 142 are generally alike in construction and operation and differ only in the single detail set forth below required to adapt them for right-hand or left-hand installation and use, as indicated by the letters "R" (right) and "L" (left) molded into the lock-operating pivots 140 and 142 respectively, these being conveniently manufactured by their being cast from a suitable metal.

Each of the lock-operating pivots 140 and 142 includes a rectangular base portion 144 dimensioned to fit the sash grooves 58. Projecting rearward in spaced parallel relationship from the four corners of the base portion 144 are four prongs 146 which serve the purpose of driven fasteners. Projecting forward from the base portion 144 near one end thereof is a pivot cam boss 148 consisting of a cylindrical pivot portion 150 adapted to fit into the sash guide front wall groove 82. Superimposed upon and integral with the cylindrical pivot portion 150 is either a leftward-slanting cam lug 152 (FIG. 13) for the right-hand lock-operating pivot 140 or a rightward-slanting cam lug 154 (FIG. 16) for the left-hand lock-operating pivot 142.

In operation, either of the slanting cam lugs 152 or 154 coacts with its respective sash balance locking lever 96 to lock or unlock the latter by sliding therealong in response to the tilting of the sash being moved bodily therewith as shown in FIGS. 3 and 4 for the operation of the eccentric pin 108, which the slanting cam lug 152 or 154 replaces. The modified lock-operating pivots 140 and 142 have the advantage not only of greater strength and dependability but also that of being easily driven into position in their respective sash grooves 58 and firmly held therein by the four prongs 146 embedded therein by the driving blow or blows.

I claim:

1. A self-locking automatically-releasing sash balance for a tiltably removable sliding sash window frame, in which an elongated channel sash guide is adapted to be mounted vertically in the window frame on opposite sides thereof, said channel sash guide having spaced substantially parallel front and rear walls and spaced opposite side walls interconnecting said front and rear walls, said front wall having an elongated longitudinal aperture therein with spaced parallel opposite edge portions, and a lock carrier is reciprocably mounted in said channel sash guide, and a sash balancing spring is mounted in said channel sash guide and having an upper portion thereof anchored to an upper portion of said sash guide and having a lower portion connected to said lock carrier, and a locking member is movably mounted on said lock carrier for motion into and out of locking engagement with one of said sash guide walls, that improvement which comprises a lock operator adapted to be mounted on a lower portion of one side of the sash and having a projection extending through said aperture including a pivot portion pivotally engaging said sash guide edge portions and a straight eccentric portion operatively engaging said locking member, said lock operator being responsive to the tilting of the sash out of and into the window frame for moving said locking member respectively into and out of locking engagement with said one sash guide wall, and a sash keeper immovably mounted on an upper portion of said one side of the sash remote from said lock operator for motion into and out of releasable gripping engagement with said edge portions of said aperture in response to the tilting of the sash into and out of the window frame.

2. A self-locking automatically-releasing sash balance, according to claim 1, wherein said lock operator includes a mounting member adapted to be secured to the side of the sash and wherein said projection has an outer end secured to said mounting member, and wherein said projection has an inner end, wherein said eccentric portion is disposed on said inner end within said sash guide, and wherein said pivot portion is disposed intermediate said outer end and said inner end of said projection.

3. A self-locking automatically-releasing sash balance, according to claim 1, wherein said eccentric portion comprises a pin disposed eccentric to the pivot axis of said pivot portion.

4. A self-locking automatically-releasing sash balance, according to claim 1, wherein said eccentric portion comprises a cam having a cam portion disposed eccentric to the pivot axis of said pivot portion and engageable with said lock operator.

5. A self-locking automatically-releasing sash balance, according to claim 1, wherein said edges of said sash guide aperture have shallow beaded enlargements extending therealong.

6. A self-locking automatically-releasing sash balance, according to claim 1, wherein said sash keeper comprises an attachment base and a wedge-shaped portion adapted to yieldingly and releasably grip said edge portions of said sash guide aperture.

7. A self-locking automatically-releasing sash balance for a tiltably removable sliding sash window with a window frame, in which:

an elongated channel sash guide is adapted to be mounted vertically in the window frame on opposite sides thereof, said channel sash guide having spaced substantially parallel front and rear walls and spaced opposite side walls interconnecting said front and rear walls, said front wall having an elongated longitudinal aperture therein with spaced parallel opposite edge portions, and a lock carrier is reciprocably mounted in said channel sash guide, and a sash balancing spring is mounted in said channel sash guide and having an upper portion thereof anchored to an upper portion of said sash guide and having a lower portion connected to said lock carrier, and a locking member is movably mounted on said lock carrier for motion into and out of locking engagement with one of said sash guide walls, that improvement in which the lock carrier comprises:

a T-shaped housing formed of a main stem and a cross-bar, a spring loop at one closed end of the cross-bar, said stem and cross-bar being separated by a slot closed by a fulcrum plate extending from the other end of the cross-bar to the juncture of that other end to the main stem, and in which said locking member comprises a flat plate of hard material having a sharp tooth at one end movable to contact a window channel and a heel portion at the other end movable to contact said closed end of said cross-bar, cam actuating surfaces on one edge of said plate between said tooth and said heel portions, and a V-notch on the opposite edge of said plate to serve as a fulcrum on said fulcrum plate of said lock carrier, and a lock operator comprises a base to be mounted on a channel side of the sash and a projection extending from said base through said elongate aperture including a pivot portion to serve as a trunnion in said aperture and an eccentric extension relative to said pivot portion to overlie the stem portion of said carrier and cooperate with said cam portions of said locking member to move said locking member from a lock position in which said tooth is engaged with said window channel and said heel is in contact with said closed end of said cross-bar, to a release position in which said tooth is released and spaced from said window channel.

8. A self-locking automatically-releasing sash balance as defined in claim 7 in which said lock operator comprises a flat plate having a circular trunnion boss at one end extending from one side of said plate, said boss having spaced eccentric holes on either side of the axis of said boss to receive selectively an actuator pin to position eccentrically of said axis to contact and actuate said cam surfaces of said locking member.

9. A self-locking automatically-releasing sash balance as defined in claim 7 in which said lock operator comprises a flat plate having a circular trunnion boss at one end extending from one side of said plate and a flat actuator projecting from said boss extending diametrically across the axis of said boss at an angle to provide an actuating axial surface eccentric to the said axis to contact and actuate said cam surfaces of said locking member.

* * * * *